US012729050B1

(12) United States Patent
Kovesdy

(10) Patent No.: US 12,729,050 B1
(45) Date of Patent: Sep. 8, 2026

(54) MULTI-FUNCTIONAL COOLER FOR RECREATIONAL BOATING AND CAMPING

(71) Applicant: Arthur Z. Kovesdy, Rocky River, OH (US)

(72) Inventor: Arthur Z. Kovesdy, Rocky River, OH (US)

( * ) Notice: Subject to any disclaimer, the term of this patent is extended or adjusted under 35 U.S.C. 154(b) by 0 days.

(21) Appl. No.: 19/006,582

(22) Filed: Dec. 31, 2024

Related U.S. Application Data

(60) Provisional application No. 63/617,814, filed on Jan. 5, 2024.

(51) Int. Cl.

| | |
|---|---|
| ***B65D 81/38*** | (2006.01) |
| ***A47G 23/06*** | (2006.01) |
| ***B65D 25/04*** | (2006.01) |
| ***B65D 25/42*** | (2006.01) |

(52) U.S. Cl.
CPC ..... *B65D 81/3823* (2013.01); *A47G 23/06* (2013.01); *B65D 25/04* (2013.01); *B65D 25/42* (2013.01); *B65D 81/3816* (2013.01)

(58) Field of Classification Search
CPC .... B65D 81/3816; B65D 25/04; B65D 25/42; B65D 81/3823; B65D 51/24; F25D 3/08; F25D 3/06; F25D 19/00; A47J 47/005; A47J 23/06; H01F 7/02; H01F 7/0252
USPC ..... 220/592.03; 206/216
See application file for complete search history.

(56) References Cited

U.S. PATENT DOCUMENTS

| | | | | | |
|---|---|---|---|---|---|
| 1,005,709 | A | * | 10/1911 | Jackson | A45C 9/00 190/30 |
| 3,598,164 | A | * | 8/1971 | August | A47J 47/005 269/15 |
| 3,713,188 | A | * | 1/1973 | Holladay | A22C 25/06 452/196 |
| 4,454,630 | A | * | 6/1984 | Shouldis | A22C 25/06 269/295 |
| D282,043 | S | * | 1/1986 | Morin | D7/552.2 |
| 4,846,076 | A | * | 7/1989 | Menges, Sr. | A01K 97/22 297/188.09 |
| 5,628,681 | A | * | 5/1997 | White | A22C 25/06 452/194 |
| 5,730,282 | A | * | 3/1998 | Bureau | A45C 11/20 312/258 |
| 5,816,433 | A | | 10/1998 | Higgins | |

(Continued)

*Primary Examiner* — Ernesto A Grano
(74) *Attorney, Agent, or Firm* — Gugliotta & Gugliotta LPA

(57) ABSTRACT

A multi-functional cooler is provided designed specifically for recreational boating. The cooler, crafted via blow molding or injection molding, features a dual-purpose design, serving both as a cooling storage unit and a tabletop. It comprises an insulated shell divided by a central divider into two compartments, each housing a slideable cooler drawer. These components are constructed from foam-filled plastic, ensuring both buoyancy and durability. The top of the shell is designed as a flat, stable tabletop with integrated cavities for securely holding cups. A unique aspect of this cooler is the inclusion of a separable tray element, designed to align and nest over the tabletop. This tray, equipped with molded feet, fits into the tabletop cavities, providing additional stability and versatility. This invention addresses the need for compact, multi-use accessories in the constrained space of small boats, combining practicality and convenience in marine environments.

12 Claims, 5 Drawing Sheets

(56) References Cited

U.S. PATENT DOCUMENTS 5,890,613 A * 4/1999 Williams ..... A45C 7/0045 220/23.4
5,904,271 A * 5/1999 Collins ..... A47J 47/005 222/143
5,975,334 A * 11/1999 Mayo ..... A45C 11/20 220/592.2
6,354,104 B1 * 3/2002 Feagin ..... B01L 7/00 70/68
6,471,059 B2 * 10/2002 Purvis ..... G09F 23/00 206/545
D472,776 S * 4/2003 Porter ..... D7/698
6,726,050 B1 * 4/2004 Barentine ..... A22C 25/06 220/23.6
7,306,243 B2 * 12/2007 Van Horn ..... A45C 13/262 280/30
7,389,608 B1 * 6/2008 MacKay ..... A01K 97/20 206/315.11
7,637,154 B1 * 12/2009 Robbins ..... G01F 19/00 33/1 V
8,256,156 B1 * 9/2012 Burgoyne, Jr. ..... A45C 11/20 280/7.14
8,356,712 B2 1/2013 Piazza, Jr.
D718,582 S * 12/2014 Parijogi ..... D7/698
9,146,051 B2 9/2015 Kamin et al.
9,462,796 B1 * 10/2016 Ellis ..... A47C 7/62
9,476,638 B1 * 10/2016 Tyler ..... A45C 5/14
9,623,890 B1 4/2017 Horowitz
9,687,113 B2 * 6/2017 Torlai ..... A47J 47/005
9,732,550 B2 * 8/2017 Lubotta ..... E05G 1/08
10,244,806 B2 * 4/2019 Marks ..... A41F 1/002
10,316,574 B2 * 6/2019 Lubotta ..... F25D 3/08
D929,471 S * 8/2021 Meda ..... D15/79
11,414,238 B2 * 8/2022 Ahlström ..... F25D 23/028
11,747,075 B2 * 9/2023 Tang ..... F25D 11/003 62/3.62
11,821,672 B2 * 11/2023 Wang ..... F25D 23/003
12,129,099 B1 * 10/2024 Hughes ..... F25D 23/069
12,163,734 B1 * 12/2024 Hughes ..... F25D 23/069
D1,103,709 S * 12/2025 Baker ..... D7/605
2003/0016987 A1 * 1/2003 Ahmed ..... B43K 27/04 401/23
2003/0042264 A1 * 3/2003 Stanwix ..... F25D 23/065 220/592.21
2004/0119220 A1 * 6/2004 Davis ..... A47J 47/005 269/289 R
2004/0119221 A1 * 6/2004 Davis ..... A47J 47/005 269/289 R
2004/0262319 A1 * 12/2004 Fisher ..... F25D 3/08 220/528
2005/0039607 A1 * 2/2005 Comfield ..... A47J 47/005 99/324
2005/0109776 A1 * 5/2005 Camp ..... A45C 11/20 220/23.86
2006/0065665 A1 3/2006 Swartfager et al.
2008/0245793 A1 * 10/2008 Hanson ..... A45C 11/20 220/592.2
2009/0025417 A1 * 1/2009 Azzara ..... A01K 97/00 62/457.1
2009/0045204 A1 * 2/2009 Marganski ..... A45C 11/20 220/528
2010/0275642 A1 * 11/2010 Klettner ..... A45C 11/20 62/457.7
2011/0226785 A1 * 9/2011 Sakell ..... A01K 97/20 220/592.2
2013/0284619 A1 * 10/2013 Daley ..... B65D 81/361 269/309
2014/0077467 A1 * 3/2014 Galante ..... B62B 5/00 280/35
2016/0113370 A1 * 4/2016 Arel, Jr. ..... A45C 11/20 220/592.09
2016/0135559 A1 * 5/2016 Scally ..... F25D 23/12 220/592.03
2016/0348954 A1 * 12/2016 McBeth ..... B62B 1/20
2017/0231400 A1 * 8/2017 Patronaggio ..... A47C 19/22 206/216
2017/0245486 A1 * 8/2017 Larson ..... B65D 51/24
2017/0305638 A1 * 10/2017 Sonntag ..... B65D 25/2882
2017/0313492 A1 * 11/2017 Seiders ..... B65D 81/261
2018/0141718 A1 * 5/2018 Ahlström ..... B65D 25/20
2018/0186547 A1 * 7/2018 Morine ..... A47G 23/02
2018/0335241 A1 * 11/2018 Li ..... B65D 25/06
2019/0198212 A1 * 6/2019 Levy ..... F16M 11/2021
2019/0320853 A1 * 10/2019 Scott ..... A47J 47/005
2019/0329947 A1 * 10/2019 Sparks ..... A47J 47/005
2021/0285716 A1 9/2021 Kalajyan
2022/0279982 A1 * 9/2022 Scheen ..... B65D 51/24
2023/0202738 A1 * 6/2023 Braunagel ..... B65D 7/10 220/592.2
2024/0199306 A1 * 6/2024 Downie, Jr ..... H05K 5/0086

* cited by examiner

MULTI-FUNCTIONAL COOLER FOR RECREATIONAL BOATING AND CAMPING

CROSS-REFERENCE TO RELATED APPLICATIONS

The resent invention claims benefit of U.S. Provisional Application Ser. No. 63/617,814, filed on Jan. 5, 2024 and incorporated by reference as if fully rewritten herein.

BACKGROUND OF THE INVENTION

1. Field of the Invention

The present invention relates generally to portable insulated storage containers, and more particularly to multi-compartment coolers with integrated work surfaces. Specifically, the invention pertains to a dual-drawer cooler system that combines thermally-isolated storage compartments with a functional tabletop surface, primarily for use in marine and outdoor recreational environments where space optimization and multi-functionality are essential.

2. Description of the Related Art

Recent trends in recreational boating and outdoor activities have highlighted significant limitations in existing portable cooling solutions. While traditional coolers serve basic thermal storage needs, modern outdoor enthusiasts increasingly require multifunctional equipment that maximizes utility while minimizing space consumption. This is particularly critical in marine environments, where space constraints and environmental conditions create unique technical challenges.

Current solutions in the market present several technical problems that remain inadequately addressed. First, conventional coolers typically offer single-compartment storage, which creates thermal management inefficiencies when storing items requiring different temperature zones. This limitation becomes particularly problematic when users need to maintain both hot and cold items simultaneously, or when different cooling zones are desired for various types of beverages or perishables.

Second, existing cooler designs generally require top access, necessitating the removal of items from the upper layers to reach contents stored below. This access method proves especially challenging in marine environments where stability is crucial. Furthermore, the removal of items from the top surface to access the interior creates a continuous cycle of disruption when the cooler serves a dual purpose as a working surface.

Third, the integration of auxiliary features, such as table surfaces, has historically resulted in compromised thermal performance or reduced structural integrity. Previous attempts to incorporate prep surfaces either as attachments or convertible features have introduced additional failure points and stability concerns, particularly problematic in marine applications where movement and moisture are constant factors.

Fourth, the materials and construction methods traditionally employed in cooler manufacturing face significant challenges in marine environments. Standard plastic construction often fails to provide adequate buoyancy when fully loaded, while traditional insulation methods can become compromised by repeated exposure to moisture and salt air.

Several attempts have been made to address these challenges individually. For example, U.S. Pat. No. 5,816,433 (Higgins) teaches a portable cooler with an integrated storage compartment, but fails to address the need for multiple, thermally isolated zones. U.S. Pat. No. 8,356,712 (Piazza, Jr.) discloses a cooler with an integrated table surface, yet the design requires movement of the surface for interior access, limiting its utility as a stable work platform.

U.S. Pat. No. 9,146,051 (Kamin et al.) describes a multi-drawer configuration but does not solve the thermal isolation challenges between compartments or address marine-specific requirements for buoyancy and stability. Similarly, U.S. Pat. No. 9,623,890 (Horowitz) attempts to combine storage and surface functionality but relies on complex mechanical systems that are vulnerable to marine environment degradation.

Despite these various approaches, the field lacks a comprehensive solution that effectively addresses all these technical challenges while maintaining simplicity of design and reliability of operation. The need remains for a cooling system that provides separate thermal zones, convenient access without disrupting work surfaces, structural integrity for marine use, and positive buoyancy, all while maximizing space efficiency and functionality.

SUMMARY OF THE INVENTION

It is thus an object of the present invention to provide a cooler specifically adapted to address these needs.

It is a feature of the present invention to address these needs by providing a dual-purpose, blow molded or injection molded cooler.

Briefly described according to the preferred embodiment, a cooler is provided that features an innovative design that combines the functions of cooling storage and a tabletop surface, offering a versatile solution for boaters. The cooler includes a shell with an insulated central divider, creating two separate cooling compartments, each housing a slidable cooler drawer. The shell and drawers are constructed from foam-filled plastic, ensuring buoyancy and durability. The shell's top surface is designed as a flat, usable tabletop, complete with integrated cup holding cavities. A separate tray element, doubling as a serving tray, is designed to align and nest over the tabletop surface. This tray has molded feet that fit into the cavities on the tabletop, providing stability and versatility in usage.

This multi-functional cooler offers a compact, efficient, and portable solution, meeting the specific needs of recreational boaters. The multi-functional cooler provides an innovative solution for recreational boaters, particularly in smaller boats, by combining cooling storage with a practical tabletop or prep surface. The invention addresses technical challenges in several key areas: thermal management through separated storage zones, structural design incorporating sliding drawer mechanisms while maintaining durability, achieving positive buoyancy while preserving insulation effectiveness, and integration of a stable work surface suitable for food preparation and serving. The field encompasses aspects of insulation technology, mechanical design for drawer systems, materials engineering for marine-grade construction, and ergonomic considerations for outdoor use.

It is an advantage of the present invention to provide separated thermal compartments allowing different temperature zones for simultaneous storage of hot and cold items.

It is another advantage of the present invention to enable drawer-based access that eliminates the need to remove items from the top surface to reach contents stored below.

It is an advantage of the present invention to incorporate a stable work surface suitable for food preparation without compromising thermal performance or structural integrity.

It is another advantage of the present invention to ensure positive buoyancy through foam-filled plastic construction while maintaining effective insulation properties.

It is an advantage of the present invention to provide cup-holding cavities integrated into the tabletop surface for secure beverage storage in marine environments.

It is another advantage of the present invention to include a removable serving tray that doubles as an additional tabletop surface while nesting securely with the main unit.

It is an advantage of the present invention to optimize space efficiency by combining multiple functions within a single unit suitable for smaller marine vessels.

It is another advantage of the present invention to utilize corrosion-resistant materials and hardware specifically designed for marine environment durability.

It is an advantage of the present invention to incorporate drainage channels and pressure equalization features for enhanced performance in marine conditions.

It is another advantage of the present invention to provide dimensions compatible with standard marine storage spaces while maintaining interior volumes optimized for common beverage containers.

Further features of the invention will become apparent in the course of the following description.

BRIEF DESCRIPTION OF DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE INVENTION

Figure 1:
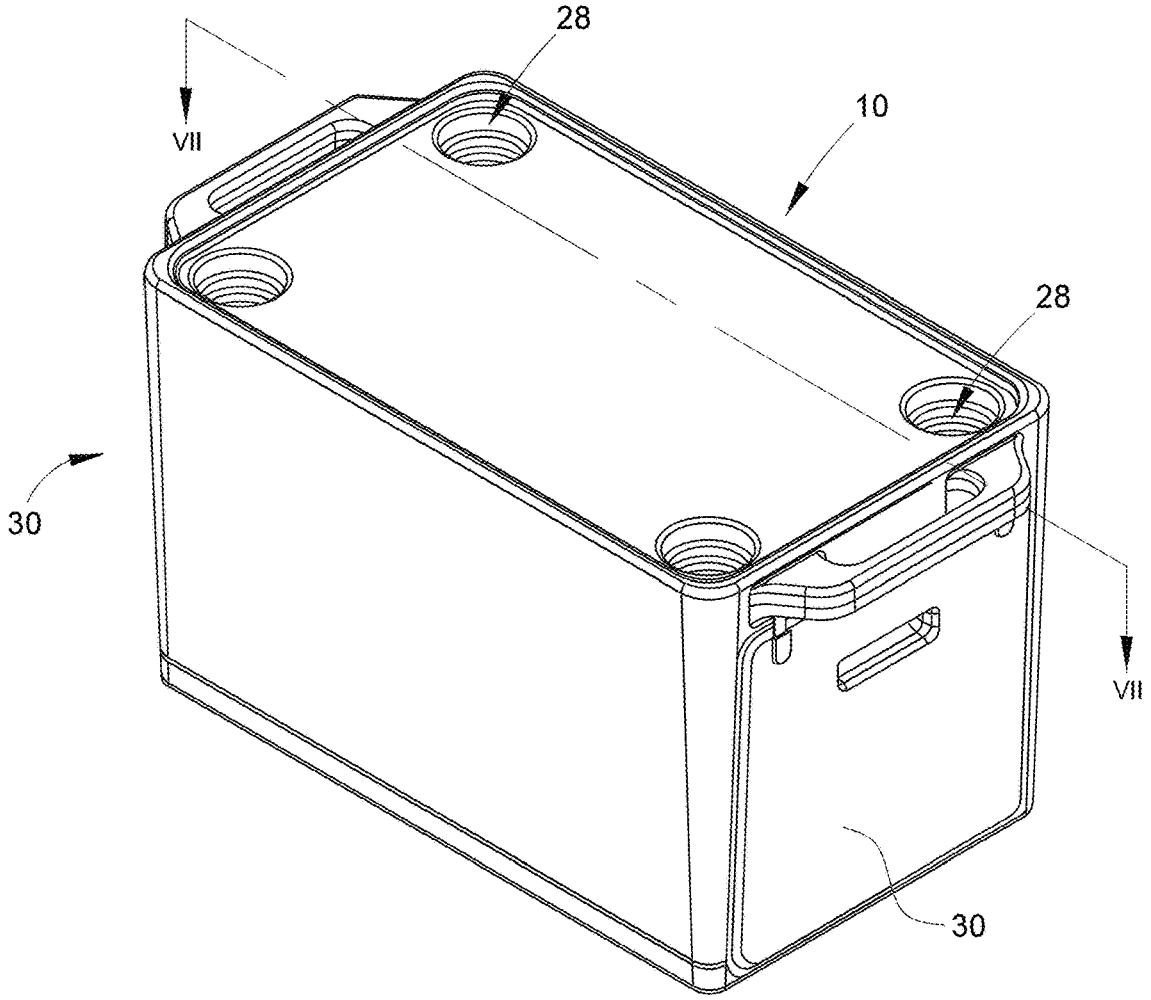
FIG. 1 is a perspective rendering of a multi-functional cooler according to a preferred embodiment of the present invention.
Figure 2:
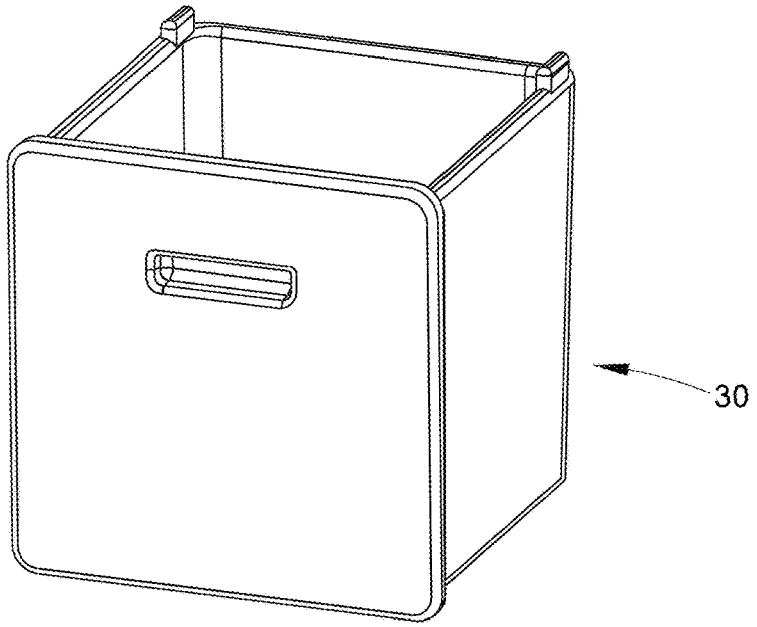
FIG. 2 is a perspective rendering of a drawer for use therewith.
Figure 3:
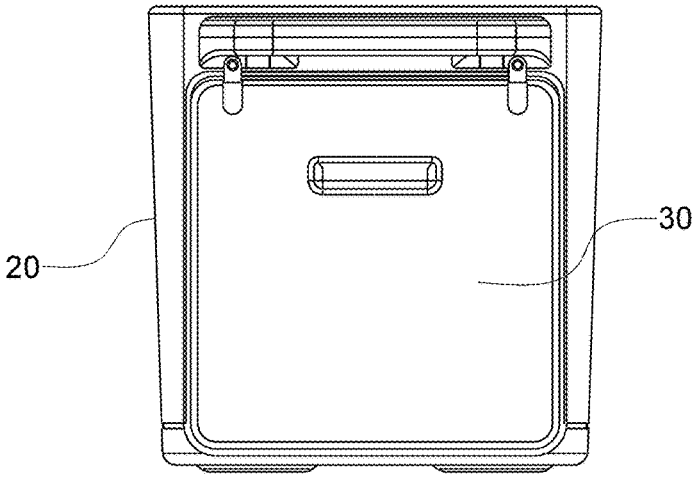
FIG. 3 is a side elevational view of the multi-functional cooler of FIG. 1, the opposite side being a mirror image.
Figure 4:
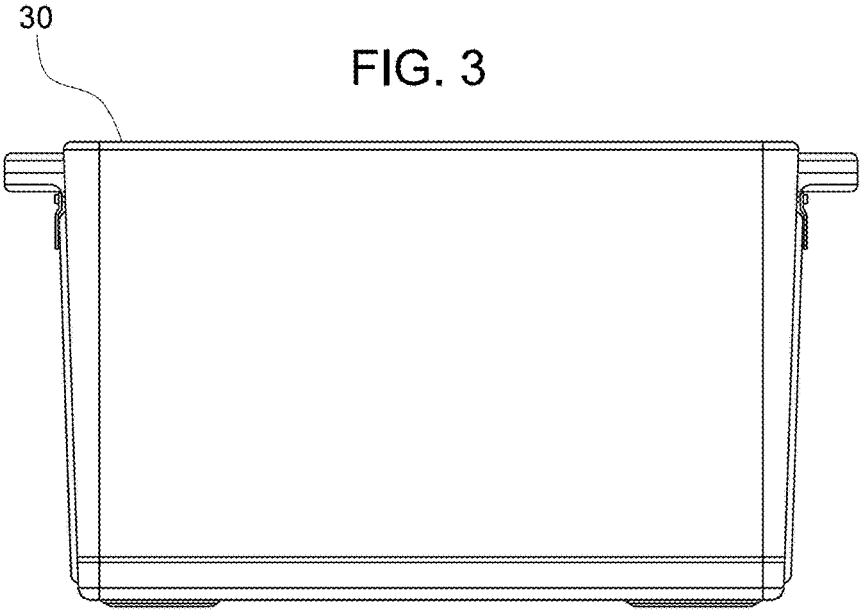
FIG. 4 is a front elevational view thereof, the rear elevational view being a mirror image.
Figure 5:
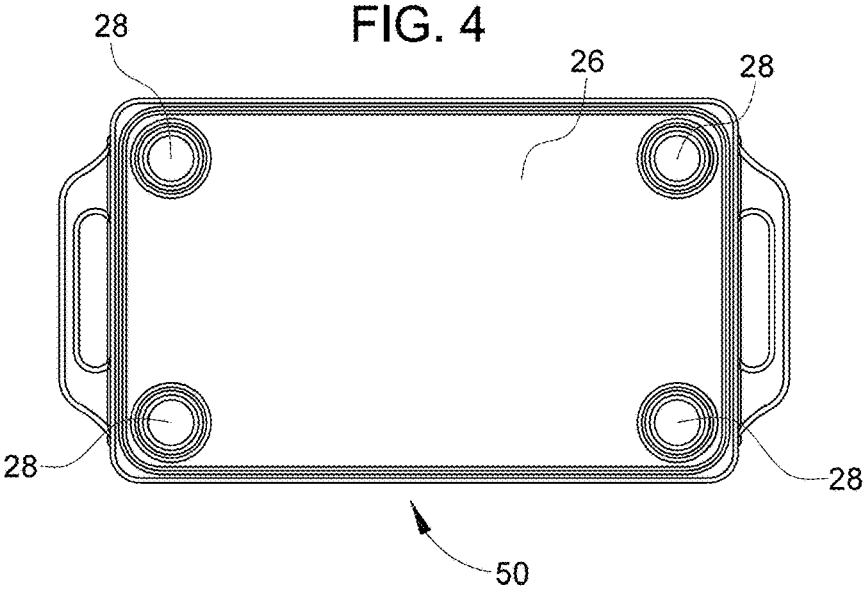
FIG. 5 is a top plan view thereof.
Figure 6:
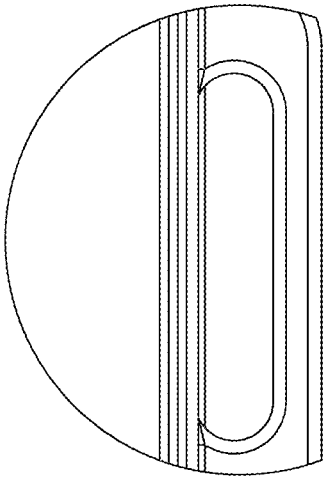
FIG. 6 is a partial detail view of a carrying handle taken along detail "R" of FIG. 5.
Figure 7:
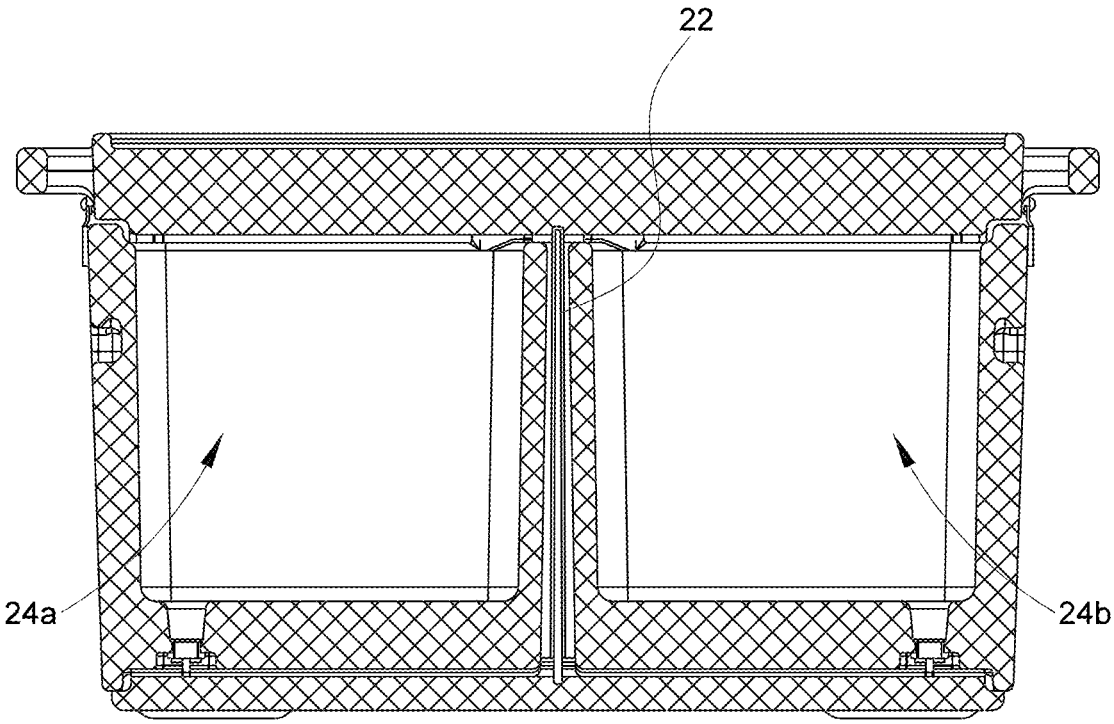
FIG. 7 is a cross sectional view taken along a horizontal centerline, identified as line VII-VII of FIG. 1.

The best mode for carrying out the invention is presented in terms of its preferred embodiment, herein depicted within the Figures. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. Further, unless a claim element is defined by reciting the word "means" and a function without the recital of any structure, it is not intended that the scope of any claim element be interpreted based on the application of 35 U.S.C. § 112 (f).

The best mode for carrying out the invention is presented in terms of its preferred embodiment, herein depicted within the Figures.

1. Detailed Description of the Figures

Referring now to the drawings, wherein like reference numerals indicate the same parts throughout the several views, a multi-functional cooler, generally noted as 10, is provided specifically designed for enhancing the recreational boating experience, particularly in smaller boats where space is at a premium. This cooler 10, crafted through a blow molding or injection molding process, is characterized by its dual-functionality as both a cooling storage unit and a tabletop or prep surface. The central feature of this cooler is its shell 20, which encompasses an insulated central divider 22 that bifurcates the interior space 24 into two distinct receiving volumes 24*a*, 24*b*. Within each of these volumes 24, a cooler drawer 30 is slidably disposed, facilitating easy access and efficient organization of contents.

The material choice for the shell 20 and drawers 30 is a foam-filled plastic, which not only assures the structural integrity and insulation properties required for a cooler but also imparts buoyancy, a critical aspect for marine usage.

The top 26 of the shell 20 is ingeniously designed to serve as a flat, stable tabletop, offering a convenient surface for various activities, from meal prep to leisurely imbibing. Integrated within this tabletop 26 are formed one or more receiving cavities 28, each ideally or differently contoured to hold cups securely, addressing the typical needs on a moving boat. Also formed in the shell 20 are a plurality of vent plug apertures, each receiving a removable vent plug 40. The vent plugs 40 are selectively removable by a user to equalize air pressure between the interior volume 24 and the exterior environment, particularly when the drawers 30 are opened or closed during use.

Figure 8A:
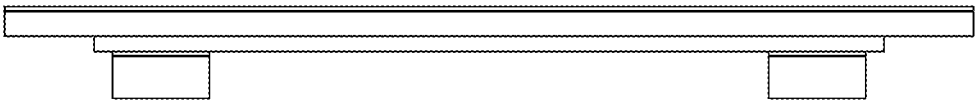
FIG. 8A through FIG. 8D are side elevation, top plan, front elevation and bottom plan views, respectively, of the separable tray elements for use therewith.
Figure 8B:
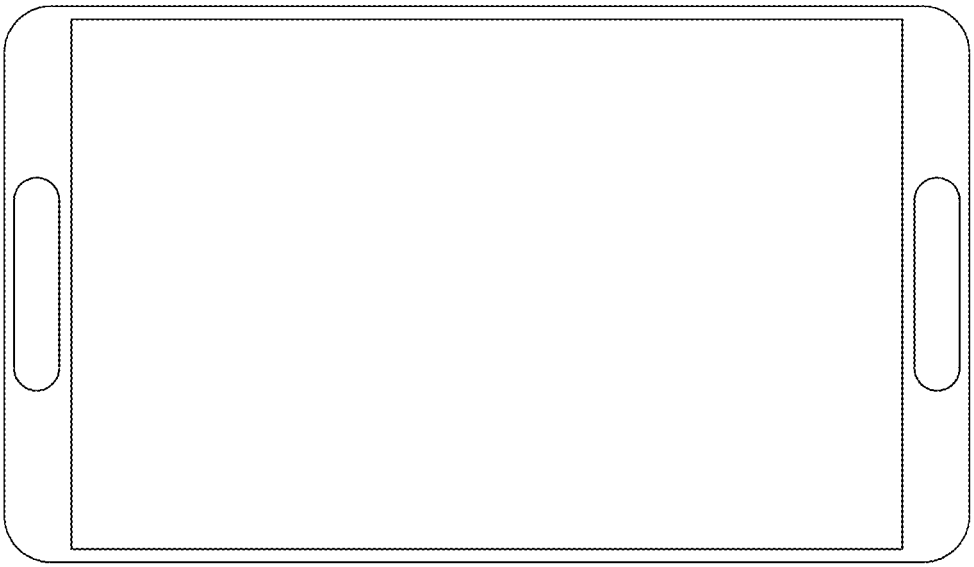
Figure 8C:
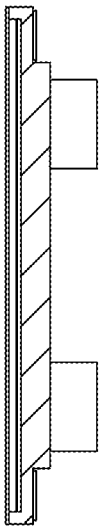
Figure 8D:
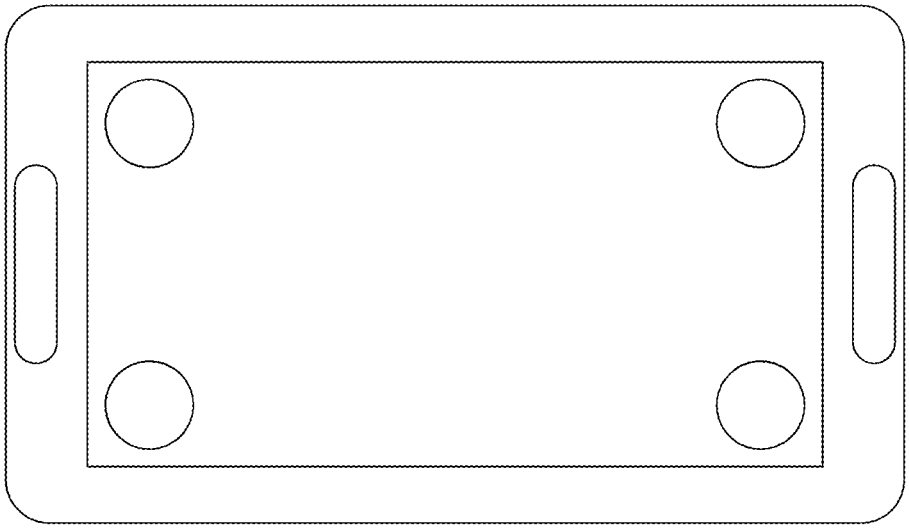

Further enhancing the utility of this invention is a separable tray element 50, as shown in conjunction with FIG. 8A through FIG. 8D. This tray is precisely configured to align and nest over the tabletop, effectively doubling as an additional tabletop surface or a portable serving tray. Notably, the tray includes several molded feet, each designed to snugly fit into the corresponding receiving cavities on the tabletop. This design ensures stability and versatility, allowing the tray to be used both as an integral part of the cooler and independently.

In its entirety, the invention presents a highly practical solution, tailor-made for the confines of a boating environment. It elegantly combines the necessity of a cooler with the luxury of a tabletop, delivering a seamless and efficient boating experience.

2. Operation of the Preferred Embodiment

In operation, the design of the present invention effectively combines the utility of a cooler with the convenience of a tabletop or prep surface, addressing the unique challenges faced by boaters, especially those on smaller vessels. The invention's compact and buoyant nature makes it particularly suited for marine environments, offering enhanced functionality without sacrificing space or convenience. The drawers, being insulated, are capable of retaining ice food, beverages or other items, and with an insulated divider therebetween may provide for separate hot or cold storage compartments. The top surface, being planar, may function as a tabletop or prep surface, and the removable tray further provides such a secondary surface that is separately portable for service. The foregoing descriptions of specific embodiments of the present invention are presented for purposes of illustration and description. The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples, and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein but is to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defined broadly by the Drawings and Specification appended hereto and to their equivalents. Therefore, the scope of the invention is in no way to be limited only by any adverse inference under the rulings of *Warner-Jenkinson Company*, v. *Hilton Davis Chemical,* 520 US 17 (1997) or *Festo Corp.* v. *Shoketsu Kinzoku Kogyo Kabushiki Co.,* 535 U.S. 722 (2002), or other similar caselaw or subsequent precedent should not be made if any future claims are added or amended subsequent to this Patent Application.

The invention claimed is:

1. A portable cooling apparatus comprising:

a thermally insulated shell having a top surface, bottom surface, and side walls defining an interior volume;

a thermal divider wall separating said interior volume into first and second thermally isolated compartments;

first and second sliding drawers disposed respectively within said first and second compartments;

wherein said top surface comprises an integrated tabletop having a plurality of recessed cup-holding cavities;

wherein said shell and drawers are formed of foam-filled plastic material providing positive buoyancy; and a removable serving tray configured to nest atop said top surface, wherein said removable serving tray comprises:

a planar surface;

a raised peripheral rim; and a plurality of projection feet configured to engage with said recessed cup-holding cavities to secure said tray to said top surface.

2. The portable cooling apparatus of claim 1, wherein said first and second sliding drawers each comprise:

a drawer body defining a storage volume;

a pair of drawer slides mounted on opposing sides of said drawer body;

a handle integrated into a front face of said drawer body; and a drain plug assembly mounted in a bottom surface of said drawer body.

3. The portable cooling apparatus of claim 2, wherein said drain plug assembly comprises:

a threaded drain opening formed in said bottom surface;

a removable drain plug having complementary threads; and a gasket providing a watertight seal between said drain plug and said drain opening.

4. The portable cooling apparatus of claim 1, wherein said thermal divider wall comprises:

an outer shell formed of plastic material;

an internal foam core providing thermal insulation; and wherein said divider wall is integrally formed with said shell during a rotational molding process.

5. The portable cooling apparatus of claim 1, further comprising:

at least one locking mechanism configured to secure said first and second sliding drawers in a closed position; and wherein said locking mechanism comprises a swing-down locking bar and protective cap.

6. The portable cooling apparatus of claim 1, wherein:

said shell includes reinforced corner sections;

said foam-filled plastic material comprises rotationally molded polyethylene with an integral foam core; and said foam-filed plastic material of said shell and drawers provides positive buoyancy such that the portable cooling apparatus floats when placed in water while loaded with contents for recreational use.

7. The portable cooling apparatus of claim 1, further comprising:

a plurality of vent plug apertures formed in said shell, each vent plug aperture receiving a removable vent plug, said vent plugs being selectively removable to equalize air pressure between the interior volume and the exterior environment when said drawers are opened or closed; and molded graphics applied to exterior surfaces of said shell.

8. The portable cooling apparatus of claim 1, wherein said first and second compartments are thermally isolated to allow:

maintaining different temperatures in each compartment;

storing hot items in one compartment and cold items in another compartment; and independent temperature control of each compartment.

9. The portable cooling apparatus of claim 1, wherein said integrated tabletop comprises:

a substantially flat upper surface;

drainage channels surrounding said recessed cup-holding cavities; and rounded edges and corners for safety.

10. The portable cooling apparatus of claim 1, further comprising:

brass inserts mounted in said shell for securing components;

nylon fittings for drawer slides; and corrosion-resistant fasteners throughout.

11. The portable cooling apparatus of claim 1, wherein:

said shell has exterior dimensions selected to fit standard marine storage spaces; said drawers have interior dimensions optimized for common beverage containers; and said top surface has dimensions suitable for food preparation.

12. A method of manufacturing the portable cooling apparatus of claim 1, comprising:

rotationally molding said shell with integral foam insulation;

installing said thermal divider during the molding process;

assembling said drawer slides and hardware; and installing said removable serving tray.

* * * * *